US008733987B2

(12) United States Patent
Lin et al.

(10) Patent No.: US 8,733,987 B2
(45) Date of Patent: May 27, 2014

(54) LOCKING CONNECTION DEVICE, LED BOX AND LED DISPLAY SCREEN

(75) Inventors: Mingfeng Lin, Guangdong (CN); Wei Wang, Guangdong (CN); Jinfeng He, Guangdong (CN); Chunwang Zhang, Guangdong (CN); Jiao Shen, Guangdong (CN)

(73) Assignee: Unilumin Group Co., Ltd., Guangdong (CN)

( * ) Notice: Subject to any disclaimer, the term of this patent is extended or adjusted under 35 U.S.C. 154(b) by 347 days.

(21) Appl. No.: 13/384,340

(22) PCT Filed: Apr. 29, 2011

(86) PCT No.: PCT/CN2011/073535

§ 371 (c)(1),
(2), (4) Date: Jan. 17, 2012

(87) PCT Pub. No.: WO2012/100469

PCT Pub. Date: Aug. 2, 2012

(65) Prior Publication Data

US 2013/0010408 A1 Jan. 10, 2013

(30) Foreign Application Priority Data

Jan. 26, 2011 (CN) ..... 2011 2 0026353 U
Apr. 22, 2011 (CN) ..... 2011 1 0102759

(51) Int. Cl.
*F21L 4/00* (2006.01)

(52) U.S. Cl.
USPC ..... 362/396; 362/191; 362/190

(58) Field of Classification Search
USPC ..... 362/396, 191, 190, 233, 249.02, 285, 362/401, 418, 419
See application file for complete search history.

(56) References Cited

U.S. PATENT DOCUMENTS 6,848,112 B2 * 1/2005 Bae et al. ..... 720/600

* cited by examiner

*Primary Examiner* — Vip Patel

(57) ABSTRACT

A locking connection device, an LED box and an LED display screen are provided. The device includes a locking module and an inserting module. The locking module includes a hook and a bump matching with each other. The inserting module includes a fixing pin and a fixing hole matching with each other. The fixing pin and hook are fixed on a first base, and the bump and the fixing hole are fixed on a second base. The locking connection device further includes a driving module that propels the hook and the fixing pin to move synchronously. When the driving module finishes a travel, the hook and the bump are securely connected, and the fixing pin and the fixing hole are securely connected. Since the locking module according to the present invention locks the movement of the first base and the second base along the axial direction of the fixing pin and meanwhile the inserting module locks a circumferential movement of the fixing pin, the first base and the second base are securely fixed. Additionally, the sizes of the fixing pin, the fixing hole, the hook and the bump can be selected to match the weight of the box to lock and connect heavy boxes, thus realizing a convenient installation.

10 Claims, 6 Drawing Sheets

LOCKING CONNECTION DEVICE, LED BOX AND LED DISPLAY SCREEN

BACKGROUND OF THE INVENTION

The present invention relates to a mechanical field, in particularly, to a locking connection device, an LED box, and an LED display screen.

An LED display screen is a joint of plural LED boxes. The LED box has a light weight and may be connected in various ways, such as louvers bolt which is easy and convenient and provides a rapid connection and detachment.

Chinese utility model application No. 200920104934.4, entitled "Unit structure of box body framework for LED display screen capable of realizing quick installation", discloses a box body device for a LED display screen capable of increasing the installation speed and realizing quick installation. The device comprises a square framework; a connecting pin is arranged on the outer lateral surface at the top of the framework; a connecting hole and a connecting inserted pin matching with the connecting pin are arranged at the bottom of the framework; and a lock tongue and a lock catch which match with each other are respectively arranged on the left lateral surface and the right lateral surface of the framework. However, this pin connection is highly limited to the loaded weight, and is not applicable to the joint of the boxes.

In the prior art, the joint of the boxes with a high loaded weight is generally realized by fixing a fixed metal piece having a relatively high strength with screws to connect and lock tightly. Two ends of the metal piece are fixed on two adjacent boxes by the screws, thereby realizing the fixed connection. However, this method of connecting the boxes is time and labour consuming in practical operations. Moreover, the boxes generally are heavy and need to be assembled by lots of people working collaboratively, which spends much time and requires lots of labour and materials.

BRIEF SUMMARY OF THE INVENTION

The present invention is mainly directed to solve a technical problem of providing a locking connection device which realizes a rapid connection and detachment and is adapted to connect heavy boxes, an LED box, and an LED display screen.

To solve the above technical problem, the present invention employs the following technical solution: there is provided a locking connection device, which includes a locking module and an inserting module. The locking module includes a hook and a bump matching with each other. The inserting module includes a fixing pin and a fixing hole matching with each other. The fixing pin and the hook are fixed on a first base, and the bump and the fixing hole are fixed on a second base. The locking connection device further includes a driving module that is used to propel the hook and the fixing pin to move synchronously, during which the hook is directed to the bump and the fixing pin is directed to the fixing hole. When the driving module finishes a travel, the hook and the bump are securely connected, and the fixing pin and the fixing hole are securely connected.

The driving module includes a handle, a pin clip, a sliding rail, a hook, a guide rail, two fixing members, two guide pillars and a rotating shaft. An axle wheel is disposed at one end of the handle. The axle wheel is provided with a first hole and a second hole. The first hole is eccentrically disposed on the axle wheel. A third hole is formed at one end of the hook. Two fixing members pass the second hole and the guide rail from two sides respectively to dynamically connect the handle and the pin clip together. Another rotating shaft passes the first hole and the third hole to connect the handle and the hanging hook. The first base is provided with two guide pillars on two sides thereof. The guide pillars pass the sliding rail. A fixing pin is fixed on one end of the pin clip. The axle wheel, during cam moving, propels pin clip to move along the sliding rail. A flat spring is fixed on the first base.

The locking connection device further includes a safety mechanism for preventing the handle from not being pressed in place or not being bounced away, and the safety mechanism is installed on the first base.

There are two axle wheels on the handle, which two are disposed parallel to each other at an interval, and one end of the hook is disposed between the two axle wheels.

The safety mechanism comprises a stop plate and a restoring spring. The stop plate is provided with a trip. One end of the restoring spring is fixed on the trip and the other end is fixed on the first base.

To solve the above technical problem, the present invention employs another solution as follow: there is provided an LED box, which includes an LED display component and an LED box frame. The LED display component and the LED box frame are securely connected, and the LED box is provided with a plurality of locking connection devices. The locking connection device includes a locking module and an inserting module. The locking module includes a hook and a bump matching with each other. The inserting module includes a fixing pin and fixing hole matching with each other. The fixing pin and the hook are fixed on the first base, and the bump and the fixing hole are fixed on second base. The locking connection device further has a driving module that propels the hook and the fixing pin moving synchronously; the hook is directed to the bump, and the fixing pin is directed to the fixing hole. When the driving module finishes a travel, the hook and the bump are securely connected, and the fixing pin and the fixing hole are securely connected.

The driving module includes a handle, a pin clip, a sliding rail, a hook, a guide rail and two fixing members, two guide pillars and a rotating shaft. An axle wheel is disposed at one end of the handle. The axle wheel is provided with a first hole and a second hole. The first hole is eccentrically disposed on the axle wheel. A third hole is formed at one end of the hook. Two fixing members pass the second hole and the guide rail from two sides respectively to dynamically connect the handle and the pin clip together. Another rotating shaft passes the first hole and the third hole to connect the handle and the hanging hook. The first base is provided with two guide pillars on two sides thereof. The guide pillars pass the sliding rail. A fixing pin is fixed on one end of the pin clip. The axle wheel, during cam moving, propels pin clip to move along the sliding rail. The flat spring is fixed on the first base.

The locking connection device further includes a safety mechanism for preventing the handle from not being pressed in place or not being bounced away, and the safety mechanism is installed on the first base.

The safety mechanism includes a stop plate and a restoring spring. The stop plate is provided with a trip. One end of the restoring spring is fixed on the trip and the other end is fixed on the first base.

To solve the above technical problem, the present invention further employs another technical solution as follows: there is provided an LED display screen including a plurality of LED display boxes which are connected by the locking connection device according to any one of claims 1 to 6.

The present invention has the following beneficial effects: Directed to solving the defects existing in the prior art that the heavy boxes are fixed by the fixed metal piece and screws, which needs lots of people working collaboratively to assembly, takes much time, and requires lots of labour and materials, the locking connection device according to the present invention securely fixes the first base and the second base by the coordination of the locking module and the inserting modules, in which the locking module locks the movement of the first base and the second base along the axial direction of the fixing pin and in the meantime, and the inserting module locks a circumferential movement of the fixing pin. Additionally, the sizes of the fixing pin and the fixing hole can be selected to match the weight of the box, so as to lock and connect heavy boxes and realize a convenient installation.

Since the locking connection device according to the present invention is provided with the fixing pin and the hook, what is needed is to substantially align two objects to be locked and have the hook to be put up, that is, hanging the hook on the bump of the second base and rotating to engage the handle. In the course of rotating the handle, the axle wheel of the handle propels the pin clip to move on the guide pillar and the pin clip drives the fixing pin inserted into the fixing hole of the second base. This coordination manner of the fixing pin and the fixing hole can ensure the two objects to be arranged neatly, and when the handle rotates, the handle can be hauled tightly by the hook so as to drive the hook to retreat, thereby securely connecting the two objects together. The locking connection device according to the present invention employs the mechanical parts linked structure inside, thereby realizing a simple and convenient locking connection process and a secure and tight connection, and further greatly saving the labour and materials spent in the assembling and maintenance processes and thus reducing the cost.

in which, 1 denotes handle; 11 axle wheel; 12 first hole; 13 second hole; 2 hook; 21 third hole; 3 first base; 31 guide pillar; 4 second base; 41 fixing hole; 42 bump; 421 screw; 422 member; 5 pin clip; 51 sliding rail; 52 guide rail; 6 fixing pin; 7 flat spring; 8 safety mechanism; 81 stop plate; 82 trip; and 83 restoring spring.

DETAILED DESCRIPTION OF THE INVENTION

To make the objectives, technical solutions, structural features, and advantages of the present invention become more apparent, the present invention is further described below in detail with reference to the accompanying drawings and embodiments.

Figure 1:
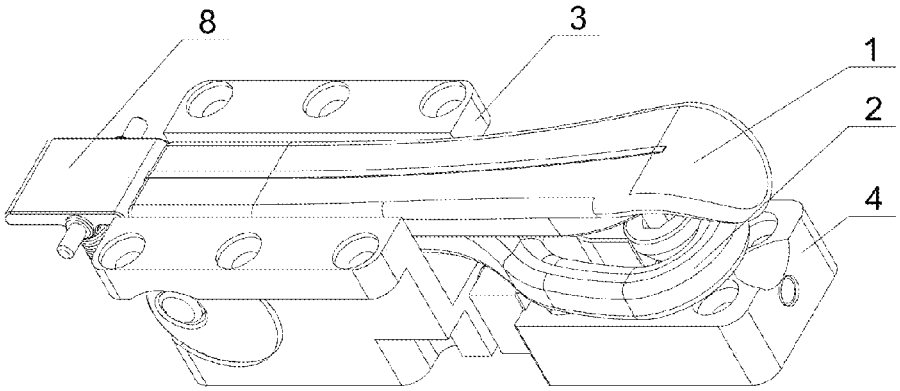
FIG. 1 is a schematic perspective structural view of a locking connection device according to the present invention.
Figure 2:
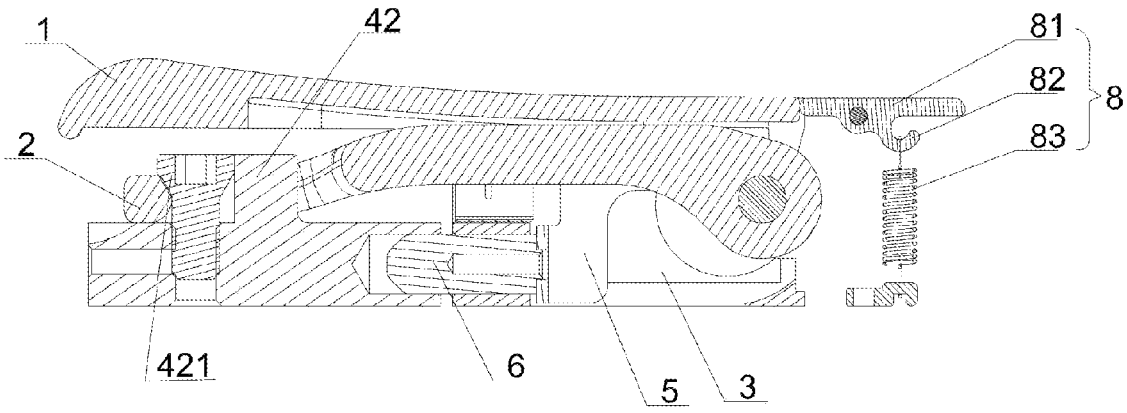
FIG. 2 is a schematic view illustrating a locked state of the locking connection device according to the present invention.
Figure 3:
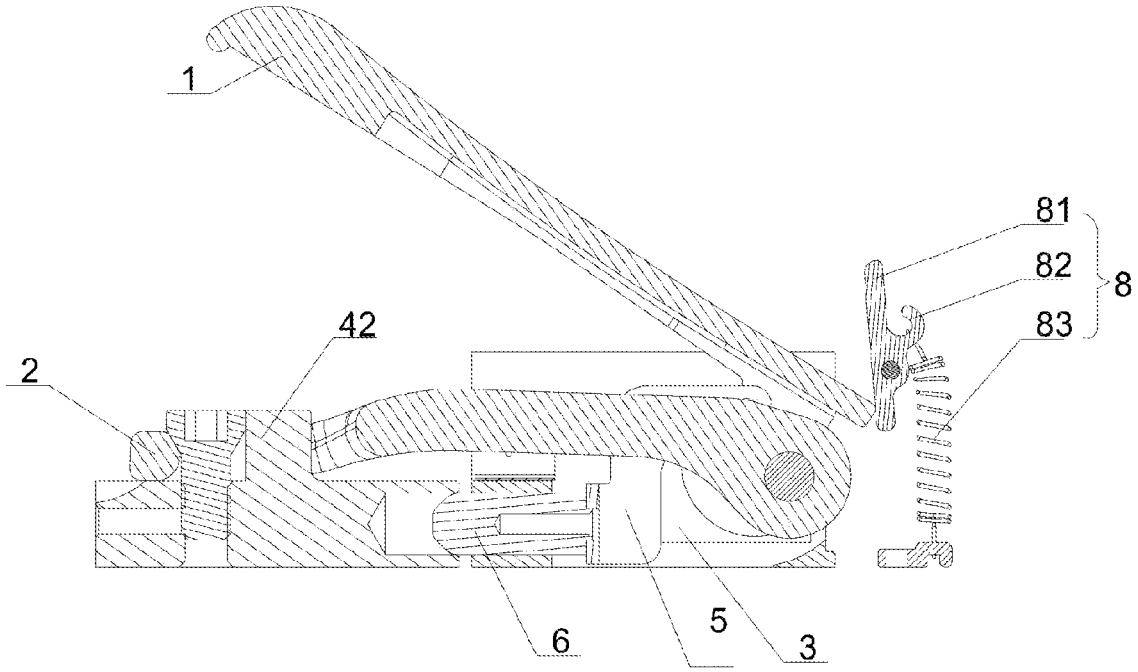
FIG. 3 is a schematic view illustrating an open state of the locking connection device according to the present invention.
Figure 4:
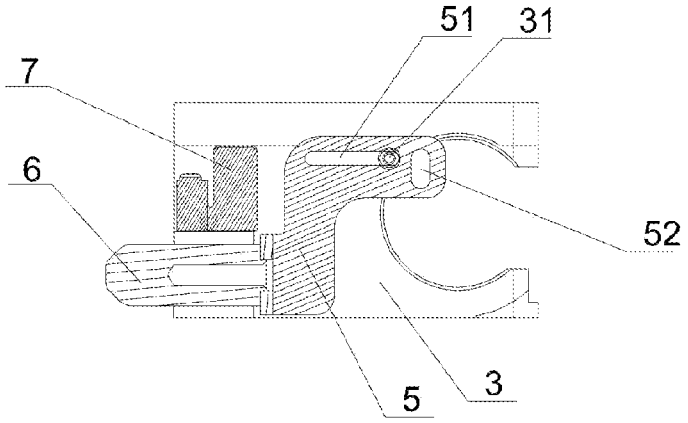
FIG. 4 is a schematic view illustrating a connection of a pin clip and a fixing pin according to the present invention.
Figure 5:
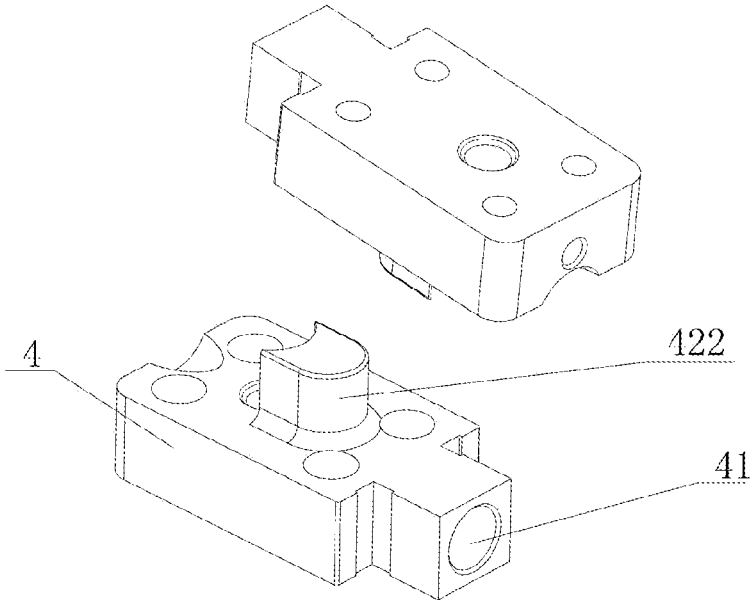
FIG. 5 is an exploded structural view of a second base according to the present invention.
Figure 6:
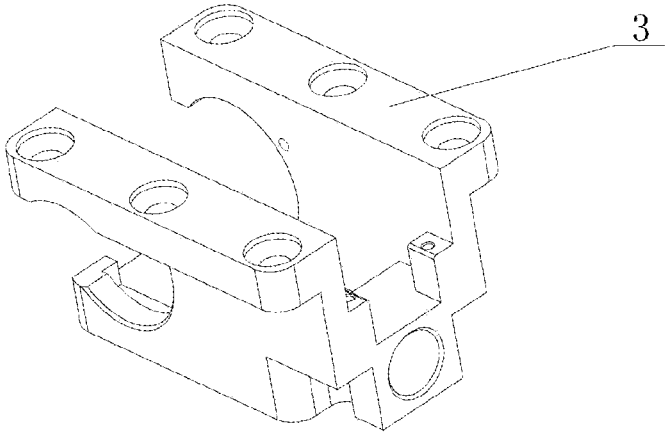
FIG. 6 is a schematic structural view of a first base according to the present invention.
Figure 7:
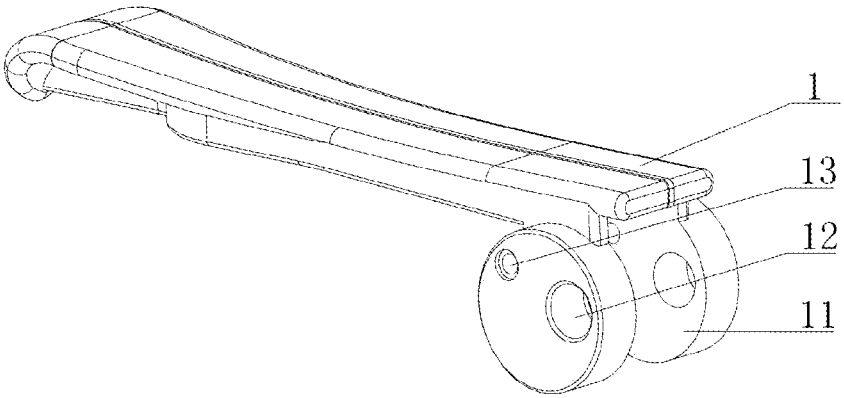
FIG. 7 is a schematic structural view of a handle according to the present invention.
Figure 8:
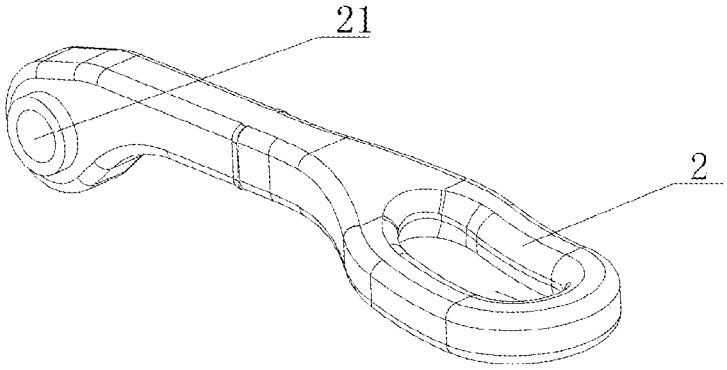
FIG. 8 is a schematic structural view of a hook according to the present invention.
Figure 9:
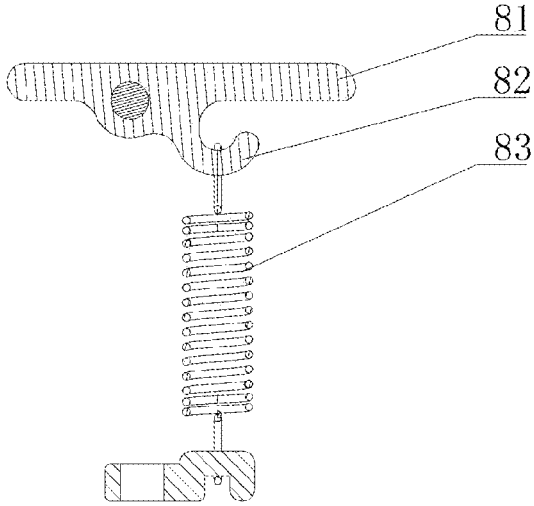
FIG. 9 is a schematic structural view of a safety mechanism according to the present invention.
Figure 10:
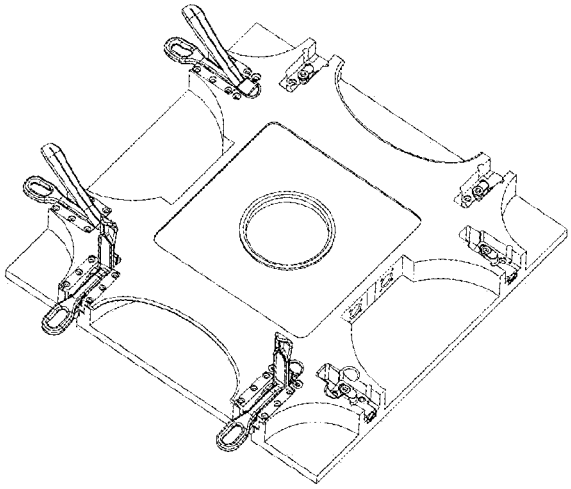
FIG. 10 is schematic view illustrating an application of the locking connection device according to the present invention in an LED display screen.
Figure 11:
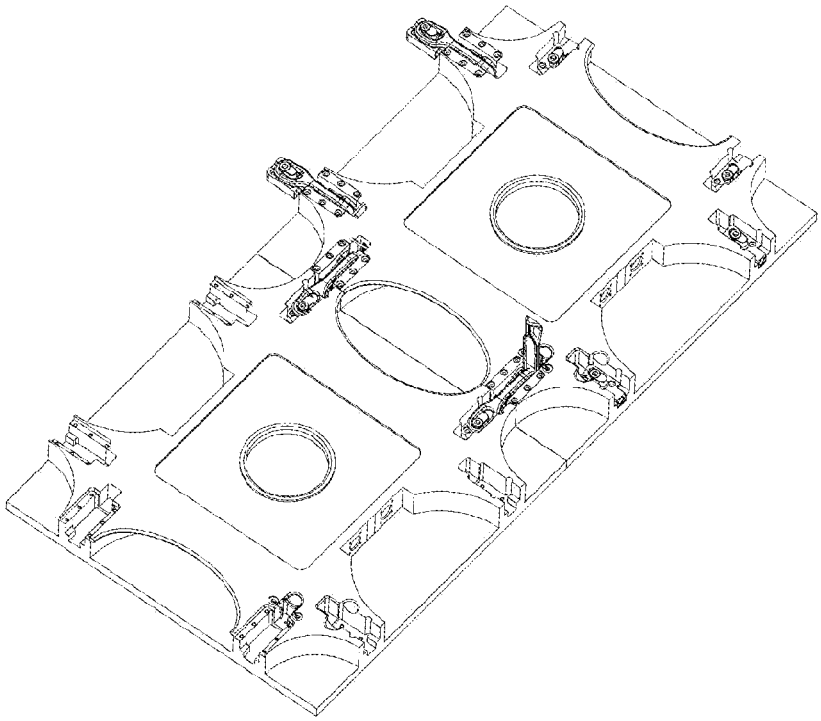
FIG. 11 is schematic view illustrating a state after the LED display screen according to the present invention is connected as a whole.
Figure 12:
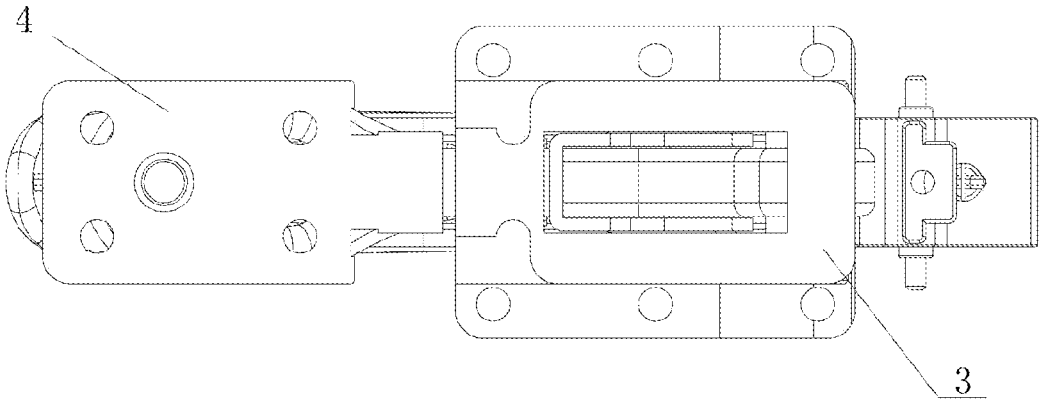
FIG. 12 is bottom view of the locking connection device according to the present invention.

Referring to FIG. 1 to FIG. 12, the locking connection device according to the embodiment of the present invention includes a locking module and an inserting module. The locking module includes a hook 2 and a bump 42 matching with each other. The bump 42 includes a screw 421 and a member 422. The inserting module includes a fixing pin 6 and a fixing hole 41 matching with each other. The fixing pin 6 and the hook 2 are fixed on a first base 3. The bump 42 and the fixing hole 41 are fixed on a second base 4. The screw 421 is fixed on the second base 4 via a screw hole, and can be adjusted to eliminate the machining error of a die. The member 422 is a part of the second base 4. The locking connection device further includes a driving module that propels the hook 2 and the fixing pin 6 moving synchronously. The hook 2 is directed to the bump 42 and the fixing pin 6 is directed to the fixing hole 41. When the driving module finishes a travel, the hook 2 and the bump 42 are securely connected, and the fixing pin 6 and the fixing hole 41 are securely connected.

Since the locking connection device according to the present invention is provided with the fixing pin 6 and the hook 2, two objects are merely needed to be substantially aligned and tied to the hook 2, that is, hanging the hook 2 on the bump 42 of the second base 4 and rotating to engage the handle 1. In the course of rotating the handle 1, the axle wheel 11 of the handle 1 propels pin clip 5 to move on the guide pillar 31 and the pin clip 5 drives the fixing pin 6 to insert into the fixing hole 41 of the second base 4. This coordination manner of the fixing pin 6 and the fixing hole 41 can ensure that the two objects are arranged neatly, and when the handle 1 rotates, the handle 1 drives the hook 2 to retreat, thus making the hook 2 draw the bump 42 of the second base 4 tightly, thereby securely connecting the two objects together. The locking connection device according to the present invention employs the mechanical parts linked structure inside, thereby realizing a simple and convenient locking connection process and a secure and tight connection, and further greatly saving the labour and materials spent in the assembling and maintenance processes and thus reducing the cost.

In an exemplary embodiment, the driving module includes a handle 1, a pin clip 5, a sliding rail 51, a guide rail 52, two fixing members, two guide pillars 31 and a rotating shaft. An axle wheel 11 is disposed at one end of the handle 1. The axle wheel 11 is provided with a first hole 12 and a second hole 13. The first hole 12 is eccentrically disposed on the axle wheel 11. A third hole 21 is formed at one end of the hook 2. Two fixing members pass the second hole 13 and the guide rail 52 from two sides respectively to dynamically connect the handle 1 and the pin clip 5 together. Another rotating shaft passes the first hole 12 and the third hole 21 to connect the handle 1 and the hook 2. The first base 3 is provided with two guide pillars 31 on two sides thereof. The guide pillars 31 pass the sliding rail 51. A fixing pin 6 is fixed on one end of the pin clip 5. The axle wheel 11 during cam moving propels pin 5 to move along the sliding rail 51. A flat spring 7 is fixed on the first base 3.

In an exemplary embodiment, the locking connection device further includes a safety mechanism 8 for preventing the handle 1 from not being pressed in place or not being bounced away, and the safety mechanism 8 is installed on the first base 3.

In an exemplary embodiment, there are two axle wheels 11 on the handle 1. The two axle wheels 11 are disposed parallel to each other at an interval, and one end of the hook 2 is disposed between the two axle wheels 11.

In an exemplary embodiment, the safety mechanism 8 includes a stop plate 81 and a restoring spring 83. The stop plate 81 has a trip 82. One end of the restoring spring 83 is fixed on the trip 82 and the other end is fixed on the first base 3.

The working principle of the locking connection device according to the present invention for locking the two objects is described as follows. Since the locking connection device according to the present invention is provided with the fixing pin 6 and the hook 2, what is needed is to substantially align two objects and have the hook 2 to be put up, that is, hanging the hook 2 on the bump 42 of the second base 4 and rotating to engage the handle 1. In the course of rotating the handle 1, the axle wheel 11 of the handle 1 propels the pin clip 5 to move on the guide pillar 31 and the pin clip 5 drives the fixing pin 6 to insert into the fixing hole 41 of the second base 4. This coordination manner of the fixing pin 6 and the fixing hole 41 can ensure that the two objects are arranged neatly, and when the handle 1 rotates, the handle 1 drives the hook 2 to retreat, thus making the hook 2 draw the bump 42 of the second base 4 tightly, thereby securely connecting the two objects together. Now, the safety mechanism 8 restores the balancing state under the resilience of the spring, thus ensuring that the handle 1 is pressed in place and will not be bounced away.

The working principle of the locking connection device according to the present invention for locking and unlocking to separate the two objects is described as follows. The unlocking action is just reverse to the locking action. Firstly, the safety mechanism 8 is unlocked, and the handle 1 is rotated to make the hook 2 forwardly move, and thus the bump 42 on the second base 4 is released and meanwhile the fixing pin 6 is disengaged from the fixing hole 41, thereby separating the two objects.

The locking connection device according to the present invention employs the mechanical parts linked structure inside, thereby realizing a simple and convenient locking connection process and a secure and tight connection, and also greatly saving the labour and materials spent in the assembling and maintenance processes and thus reducing the cost.

The above descriptions are merely taken as the preferred embodiment of the present invention, but not intended to restrict the scope of the present invention. Any equivalent structures or variants that are made by using contents of the description and drawings of the present invention, or any direct or indirect applications thereof are included in the protection scope of the claims of the present invention.

What is claimed is:

1. A locking connection device, comprising:

a locking module and an inserting module, the locking module comprising a hook and a bump matching with each other, the inserting module comprising a fixing pin and a fixing hole matching with each other, the fixing pin and the hook being fixed on a first base, and the bump and the fixing hole being fixed on a second base;

the locking connection device further comprising a driving module that is used to propel the hook and the fixing pin to move synchronously, during which the hook is directed to the bump and the fixing pin is directed to the fixing hole; wherein, when the driving module finishes a travel, the hook and the bump are securely connected, and the fixing pin and the fixing hole are securely connected.

2. The locking connection device according to claim 1, wherein:

the driving module comprises a handle, a pin clip, a sliding rail, a hook, a guide rail, two fixing members, two guide pillars and a rotating shaft; an axle wheel is disposed at one end of the handle, the axle wheel being provided with a first hole eccentrically disposed on the axle wheel and a second hole; a third hole is formed at one end of the hook; two fixing members pass the second hole and the guide rail from two sides to dynamically connect the handle and the pin clip together; another rotating shaft passes the first hole and the third hole to connect the handle and the hook; the first base is provided with two guide pillars disposed on two sides thereof, the guide pillar passing the sliding rail; a fixing pin is fixed on one end of the pin clip which is propelled to move along the sliding rail by the axle wheel during cam moving; and a flat spring is fixed on the first base.

3. The locking connection device according to claim 1, wherein the locking connection device further comprises a safety mechanism for preventing the handle from not being pressed in place or not being bounced away, the safety mechanism being installed on the first base.

4. The locking connection device according to any of claims 1 to 3, wherein there are two axle wheels on the handle disposed parallel to each other at an interval, and one end of the hook is disposed between the two axle wheels.

5. The locking connection device according to claim 4, wherein the safety mechanism comprises a stop plate and a restoring spring, the stop plate being provided with a trip, one end of the restoring spring being fixed on the trip and the other end being fixed on the first base.

6. An LED box, comprising an LED display component and an LED box frame, wherein the LED display component and the LED box frame are securely connected, and the LED box is provided with a plurality of locking connection devices, characterized in that:

the locking connection device comprises a locking module and an inserting module, the locking module comprising a hook and a bump matching with each other, the inserting module comprising a fixing pin and a fixing hole matching with each other, the fixing pin and the hook being fixed on a first base, and the bump and the fixing hole being fixed on a second base;

the locking connection device further comprises a driving module that propels the hook and the fixing pin moving synchronously, during which the hook is directed to the bump and the fixing pin is directed to the fixing hole; when the driving module finishes a travel, the hook and the bump are securely connected, and the fixing pin and the fixing hole are securely connected.

7. The LED box according to claim 6, wherein:

the driving module comprises a handle, a pin clip, a sliding rail, a hook, a guide rail, two fixing members, two guide pillars and a rotating shaft; an axle wheel is disposed at one end of the handle, the axle wheel being provided with a first hole eccentrically disposed on the axle wheel and a second hole; a third hole is formed at one end of the hanging hook; two fixing members pass the second hole and the guide rail respectively from two sides to dynamically connect the handle and the pin clip together; another rotating shaft passes the first hole and the third hole to connect the handle and the hook; the first base is provided with two guide pillars disposed on two sides thereof, the guide pillars passing the sliding rail; a fixing pin is fixed on one end of the pin clip is the pin clip being propelled to move along the sliding rail by the axle wheel during cam moving ; and a flat spring is fixed on the first base.

8. The LED box according to claim 7, wherein the locking connection device further comprises a safety mechanism for preventing the handle from not being pressed in place or not being bounced away, the safety mechanism being installed on the first base.

9. The LED box according to claim 8, wherein the safety mechanism comprises a stop plate and a restoring spring, the stop plate being provided with a trip, one end of the restoring spring being fixed on the trip and the other end being fixed on the first base.

10. An LED display screen, comprising a plurality of LED display boxes which are connected by the locking connection device according to any one of claim 1 2, 3 or 6.

* * * * *